US007317664B2

(12) United States Patent
Klein

(10) Patent No.: US 7,317,664 B2
(45) Date of Patent: Jan. 8, 2008

(54) MULTIPLAYER GAMING BUTTON

(76) Inventor: Jeff Klein, 4370 NE. Halsey, Portland, OR (US) 97213

( * ) Notice: Subject to any disclaimer, the term of this patent is extended or adjusted under 35 U.S.C. 154(b) by 9 days.

(21) Appl. No.: 11/387,006

(22) Filed: Mar. 21, 2006

(65) Prior Publication Data

US 2006/0233053 A1 Oct. 19, 2006

Related U.S. Application Data

(60) Provisional application No. 60/673,003, filed on Apr. 19, 2005.

(51) Int. Cl.
*G04B 21/08* (2006.01)

(52) U.S. Cl. ..... 368/107; 368/109

(58) Field of Classification Search ..... 368/107–109
See application file for complete search history.

(56) References Cited

U.S. PATENT DOCUMENTS

| | | | | |
|---|---|---|---|---|
| 3,817,019 | A | 6/1974 | Fowler | |
| 4,023,345 | A | 5/1977 | Imamura | |
| 4,062,180 | A | 12/1977 | Meshi et al. | |
| 4,184,320 | A | 1/1980 | Kashio | |
| 4,255,805 | A * | 3/1981 | Jaunin | 368/108 |
| 4,451,158 | A * | 5/1984 | Selwyn et al. | 368/63 |
| D276,219 | S | 11/1984 | Mox | |
| 4,505,595 | A | 3/1985 | Rose et al. | |
| D284,358 | S | 6/1986 | Chan | |
| 4,597,673 | A | 7/1986 | Kihara | |
| 4,641,125 | A | 2/1987 | Pesa | |
| 4,690,566 | A * | 9/1987 | Robertsen | 368/108 |
| 4,769,797 | A | 9/1988 | Murakami | |
| 4,888,748 | A | 12/1989 | Lagasse et al. | |
| 4,972,391 | A | 11/1990 | Juve et al. | |
| 5,058,086 | A | 10/1991 | Barlow | |
| 5,140,564 | A | 8/1992 | Rich | |
| 5,224,700 | A | 7/1993 | Rosen | |
| 5,253,228 | A | 10/1993 | Truett | |
| 5,327,403 | A | 7/1994 | Bond | |
| 5,357,487 | A | 10/1994 | Coleman, III | |
| 5,438,555 | A | 8/1995 | Kim | |
| 5,442,600 | A * | 8/1995 | Kutosky | 368/109 |
| 5,651,548 | A | 7/1997 | French et al. | |
| D386,981 | S | 12/1997 | Chae | |
| D395,607 | S | 6/1998 | Chae | |
| 5,895,321 | A | 4/1999 | Gassies et al. | |
| 6,229,764 | B1 | 5/2001 | Tongue | |
| 6,357,746 | B1 | 3/2002 | Sadowski | |
| 6,424,598 | B1 | 7/2002 | Shultz | |
| 6,547,434 | B1 | 4/2003 | DeRosa | |
| 2005/0041534 | A1 | 2/2005 | McCarthy | |
| 2005/0116416 | A1 * | 6/2005 | Peterson | 273/292 |
| 2005/0135196 | A1 | 6/2005 | Rund | |
| 2005/0243655 | A1 | 11/2005 | McCutcheon et al. | |

(Continued)

*Primary Examiner*—Gary F. Paumen
(74) *Attorney, Agent, or Firm*—Alleman Hall McCoy Russell & Tuttle LLP

(57) ABSTRACT

A multiplayer gaming button for tracking dealer position and betting schedules. The multiplayer gaming button includes a single input configured to set the primary countdown timer without using any other inputs and/or a primary countdown timer configured to be set to a primary time interval and countdown from the primary time interval to zero, wherein the primary countdown timer automatically resets to the primary time interval upon reaching zero. The multiplayer gaming button can be packaged in a standard card box.

16 Claims, 1 Drawing Sheet

U.S. PATENT DOCUMENTS

2006/0247012 A1* 11/2006 Walker et al. ..... 463/20
2007/0075491 A1* 4/2007 Mongkolkasetarin ... 273/148 R
2007/0149278 A1* 6/2007 Walker et al. ..... 463/20
2007/0167208 A1* 7/2007 Acres ..... 463/16
2007/0178955 A1* 8/2007 Mills ..... 463/13

* cited by examiner

MULTIPLAYER GAMING BUTTON

CROSS REFERENCE TO RELATED APPLICATIONS

This application claims the benefit of U.S. Provisional Application No. 60/673,003, filed Apr. 19, 2005. The entirety of the above listed application is incorporated herein by reference for all purposes.

BACKGROUND AND SUMMARY

In Texas Hold'em, as well as in other poker games, selected players are required to place bets before the cards are dealt. These bets are referred to as "blinds," because the players making these bets cannot see their cards before placing the bets (i.e., they are betting in the blind). Typically, two players are required to make blind bets. The players that are required to make the blind bets are typically the two players to the immediate left of the player in the dealer's position. The person to the left of the dealer's position typically makes a small blind, and the person to the left of the small blind position makes a big blind. The big blind is typically twice as large as the small blind.

The magnitude of the blinds can be scheduled to go up according to a set time schedule. For example, during the first 20 minute round, the small blind may be set at $25 and the big blind may be set at $50. During the second 20 minute round, the small blind may go up to $100 while the big blind goes up to $200, and so on. Virtually any schedule can be used, with the duration of the intervals and/or the amount of the blinds being selected as desired.

This betting structure relies on keeping track of which player is in the dealer's position, whether or not the person in that position actually deals the cards. In some games, a single person may deal the cards every hand, although the dealer's position moves one player to the left every hand. In other games, the person who actually deals the cards may change every hand. A dealer's button, herein referred to simply as a button, can be used to keep track of the dealer's position. A button is a marker used to indicate the player who is in the dealer's position. Virtually any marker can be used as a button.

The inventor herein has recognized that current buttons are not adequate for managing many aspects of a multiplayer game. For example, while virtually any marker can be used to keep track of a dealer's position, many game players find specifically sized and shaped buttons to be more useful than others. Furthermore, although the blind betting structures to which the dealer's position corresponds often rely on keeping accurate track of time, current buttons do not include any mechanism for keeping track of time. In addition, other aspects of game play are not addressed by current buttons. For example, during some games, it is desirable to selectively regulate the time a player is given to make a decision. As such, a secondary timer, independent of a primary timer, may be useful. Current buttons do not include primary timers for keeping track of when blind bet amounts are to be raised, let alone secondary timers that can be used to regulate the time a player is given to make a decision.

It is not a satisfactory solution to use timing devices that are not specifically designed to operate as a multiplayer gaming button. A discerning game player often will not tolerate distractions from the game at hand. The inventor herein has recognized that known timing devices suffer from one or more deficiencies, which can cause distractions that interrupt or otherwise make a game less enjoyable. Such deficiencies include, but are not limited to, difficult to set, difficult to repeat a previously completed interval, difficult to pause, no warning provided prior to the end of a time interval, relies only on audible alarm to indicate end of time interval, settings too easy to change accidentally, difficult for others to detect if changes are made to any settings, not capable of easily starting a secondary timer, no warning provided prior to the end of a secondary time interval, sized too big, sized too small, sized inconsistent with game aesthetic, shaped inconsistent with game aesthetic, sized and shaped confusingly similar to other game pieces (e.g., poker chips), and not sized and shaped to be packaged in a container that is already well established in the game.

At least some of these issues can be addressed by a multiplayer gaming button that includes a timer for keeping track of a betting schedule or other game related time information. To facilitate pleasurable game play, the timekeeping button can include inputs for easily setting a game specific time interval that is to be tracked, and for starting, stopping, and/or resetting the timer. In some embodiments, the button can include an alarm mechanism for indicating when a game specific time interval has elapsed. Such an alarm mechanism can include audio and/or visual indicators. The alarm mechanism can optionally be configured to provide warnings at set times before the game specific time interval has elapsed. In some embodiments, the alarm mechanism can indicate whenever selected settings are changed so that it is easy to detect accidental changes and/or changes by unscrupulous game players. In addition to keeping track of a primary time interval, the timekeeping button can optionally be configured to keep track of an secondary time interval independent of the primary time interval.

WRITTEN DESCRIPTION

Figure 1:
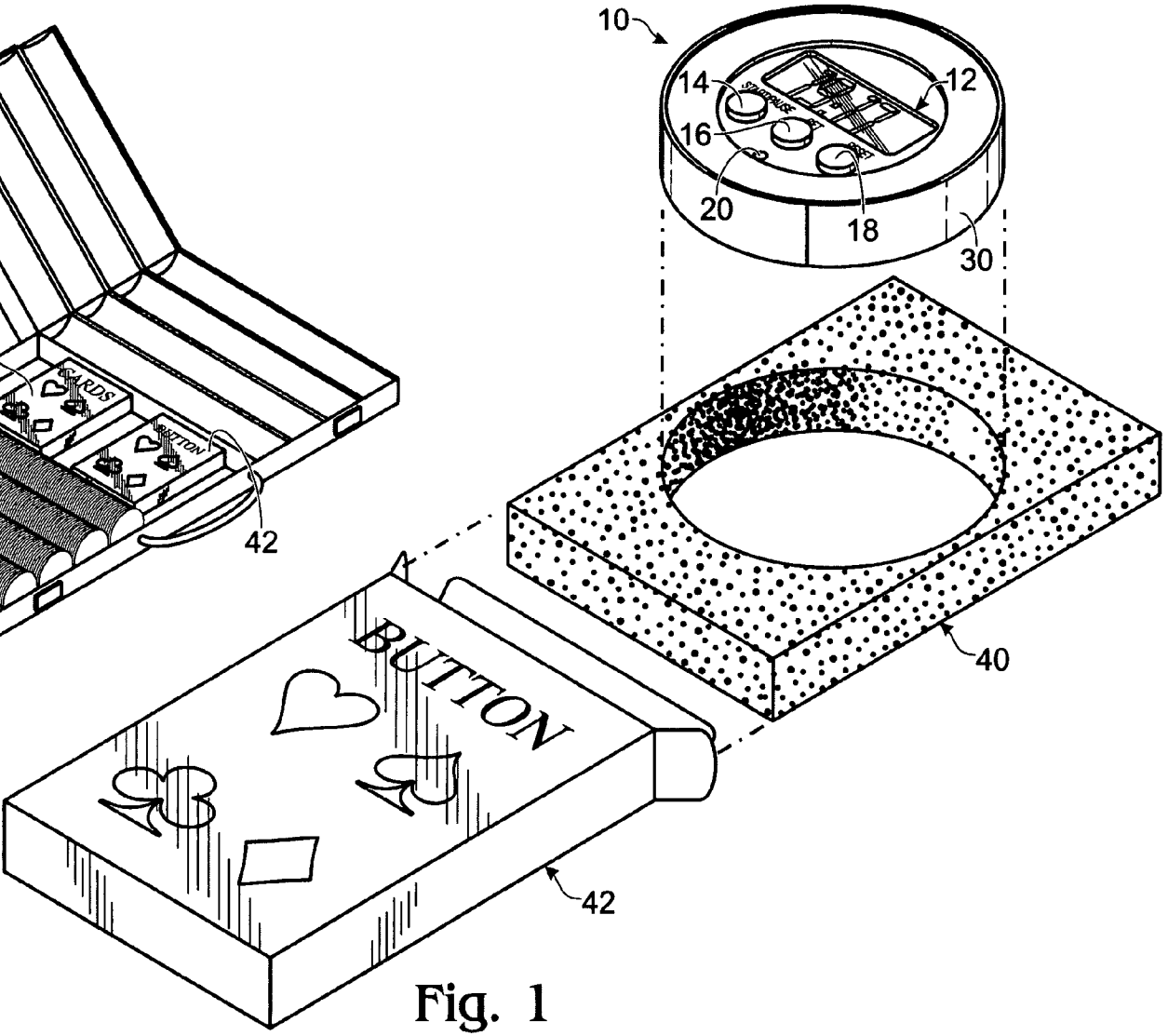
FIG. 1 shows an exemplary timekeeping button with optional packaging.

FIG. 1 shows a nonlimiting example of a timekeeping button 10, which can be used to manage various aspects of a multiplayer game, including, but not limited to, a dealer's position and/or a betting schedule. In the illustrated embodiment, timekeeping button includes a display 12, a first input, 14, a second input 16, and a third input 18. The timekeeping button can also include an alarm configured to provide audio and/or visual information. In the illustrated embodiment, the timekeeping button includes a light 20 and a speaker (not shown). While the present disclosure provides button 10 as a nonlimiting example of a timekeeping button, it should be understood that a timekeeping button may need not include every feature described herein. Similarly, some timekeeping buttons can include alternative, additional, and/or modified features while remaining within the scope of this disclosure.

Display 12 can include a generally rectangular liquid crystal display (LCD), although this is not required. Other types of displays, including, but not limited to, light emitting diode (LED) and organic light emitting diode (OLED) displays can be used. Display 12 can be a color display, a monochromatic display, or a dual mode display that can operate in a color mode or a monochromatic mode.

Display 12 can be configured to present one or more types of information to a user. For the sake of simplicity, the present disclosure provides only time information as an example. In the illustrated embodiment, display 12 is configured to present four seven-segment digits. As such, display 12 can accurately differentiate: 1) 0 seconds to 9,999 seconds; 2) 0 minutes to 99 minutes, 59 seconds; 3) 0 minutes to 99 hours, 59 minutes; and/or 4) 0 hours to 9,999 hours. A display can be configured with a different number of digits in order to increase the maximum time that can be presented and/or to decrease the smallest unit of time presented by the display (e.g., tenths of seconds). Furthermore, the display need not present only seven-segment digits, and in some embodiments, a screen capable of presenting various numbers, letters, graphics, still images, and/or video images can be used.

In the illustrated embodiment, timekeeping button includes three inputs for controlling the operation of the button. A timekeeping button can have more or fewer inputs and remain within the scope of this disclosure. The inputs can take the form of buttons, as shown, although this is not required. Switches, knobs, dials, and/or virtually any other form of user controllable input is within the scope of this disclosure. In some embodiments, display 12 may include a touch-screen input. While a particular functionality is provided below for each of the three illustrated inputs, it should be understood that modifications can be made.

Input 14 can be a "START/PAUSE" button, input 16 can be a "SET/BET" button, and input 18 can be a "RESET" button. A RESET button can be configured to reset a time displayed on display 12 to 00:00. In order to decrease the likelihood that time is accidentally reset, a RESET button can be configured to only reset the time if the button is pressed and held for a minimum amount of time, such as 2 seconds. Alternatively, time can be reset by simultaneously pressing two buttons, such as a reset button and a set button or a start button and a set button. The reset button can be configured so that it can reset the time during all modes of operation, thus making it easier to use. For example, if a timer is counting, and display 12 is presenting a remaining time (e.g., 19:17 as illustrated) as it decreases, a RESET button can be used to reset the time to 00:00 without first having to stop the timer or take some other action. The timekeeping button can be configured to indicate whenever time is reset by sounding an audible alarm and/or displaying a visual alarm.

A SET/BET button can add a predetermined time increment to the timer under predetermined operating conditions. For example, the timekeeping button can be configured so that a SET/BET button only adds time to the timer if the timer is stopped, paused, or otherwise is not counting. If the timer is counting (i.e., time is decreasing for a countdown timer or increasing for a countup timer), a SET/BET can be configured to perform an auxiliary function different than adding time to the timer.

A SET/BET button can add the same time increment every time it is pressed, or the increment can change depending on the time that is set on the timer. For example, a SET/BET button can be configured to add five minutes to the timer every time that it is pressed until reaching a maximum amount, and then optionally return to 00:00 (i.e., 00:00, 05:00, 10:00, 15:00 . . . 90:00, 95:00, 00:00). As one alternative, a SET/BET button can be configured to add one minute every time that it is pressed until reaching fifteen minutes, and then five minutes every time that it is pressed until reaching a maximum amount (i.e., 00:00, 01:00, 02:00 . . . 14:00, 15:00, 20:00, 25:00 . . . 90:00, 95:00, 00:00). In some embodiments the timer will not return to zero when the set button is pressed after a maximum time amount has been reached. As demonstrated by these nonlimiting examples, a timer can quickly and easily be set to a desired time with a single input (e.g., button). A single button can be used to quickly set times up to 95 minutes or more depending on the selected increments that are added to the timer and the preselected maximum time interval. Because the timekeeping button is specifically designed for multiplayer gaming, the increments that are added to the timer can be preselected to correspond to a particular game, so it is quick and easy to set the timer to a time that is relevant for that particular game. Other timers that are not specifically designed for multiplayer gaming may require a user to cycle through every possible time and/or use more than one input to set the timer. The timekeeping button can be configured to indicate whenever time is added to the timer by sounding an audible alarm and/or displaying a visual alarm, although this is not required.

A START/PAUSE button can be used to begin counting if the timer is paused, and to pause the timer if the timer is counting. The timekeeping button can be configured to indicate whenever the timer is started or paused by sounding an audible alarm and/or displaying a visual alarm, although this is not required.

While the timer is counting, a SET/BET button can optionally be used to perform an auxiliary function, such as activating a secondary timer that runs independent of the primary timer. The secondary timer can countdown from a preselected time without affecting operation of the primary timer. As a nonlimiting example, the secondary timer can count down a 30 second interval without disrupting the primary timer. This can be useful in several multiplayer games, where, on occasion, a secondary timer is useful. For example, in a game of poker, if a player is taking a long time to decide whether to bet or fold, the secondary timer can be activated, forcing that player to decide to bet or fold within the interval allowed by the secondary timer.

When the secondary timer is activated, it can temporarily be presented on display 12, although this is not required. In some embodiments, the secondary timer can be presented on a different display or the secondary timer may not be visually presented at all. The end of time counted by the secondary timer can be indicated by sounding an audible alarm and/or displaying a visual alarm. A warning indication can also be given prior to the end of secondary time elapsing. As a nonlimiting example, an audible beep and/or visual flash may be delivered 5 seconds before time has elapsed, and/or the frequency or tone of an audible beep and/or the frequency or color of a visual flash may change as the time of the secondary timer approaches zero. The sound or look of indications corresponding to the secondary timer can be different than those used for various other functions of the timekeeping button.

When included, a secondary timer can operate completely independently of the primary timer, so that the primary timer can continue to count as normal, even if the secondary timer is counting. A secondary timer can be activated more than once while the primary timer is counting the primary time.

The primary timer can be configured to count a selected time so that various game timing functions can be accurately tracked. As a nonlimiting example, a primary time interval can be set so that players can raise a minimum betting amount every time the primary time elapses. When the primary time elapses, audio and/or visual indications can be executed. Such alarms can be different than those used for other functions of the timekeeping button. A warning can also be delivered at a set time before the primary time elapses. As a nonlimiting example, one minute before primary time elapses, the timekeeping button may sound a single beep and light 20 may begin to shine. When the primary time elapses, the timekeeping button may continuously beep for thirty seconds while light 20 continuously flashes. This alarm can be interrupted, for example, by pressing the START/PAUSE button.

An audio and/or visual warning that is provided before the end of either the primary or secondary timer can improve the functionality of a timekeeping button in the context of a particular game. For example, a player's strategy may change as the ending of a timed period approaches, and a warning can help assure that all players recognize that the time period is about to expire. Accordingly, game players may prefer a timekeeping button that includes a warning indicator for signaling if time is about to expire over another timing mechanism that does not provide such a warning.

The timekeeping button may automatically return the primary timer to the preselected primary time interval when time has fully elapsed. This allows the same primary time interval to be used for a next round without having to set the interval a second time. This is particularly useful in many multiplayer games, where the same time interval is repeatedly used. In some embodiments, after the primary time has expired for one round, the timer can be restarted for a next round simply by pressing the START/PAUSE button. In some embodiments, the timer can automatically start counting for the next round without requiring any buttons to be pressed. By automatically returning the primary timer to the preselected primary time interval, the timekeeping button allows multiplayer gamers to easily begin a next round without having to go through the trouble of resetting a timer, which can be distracting in the middle of a game. As an alternative to automatically returning the primary timer to the preselected primary time interval, the button can include an input that is configured to return the timer to the preselected time interval upon activation of the input.

The timekeeping button can optionally be configured to automatically turn off if the primary time has elapsed and has not been restarted within a set period of time (e.g., two hours). This allows the timekeeping button to conserve energy, which can increase battery life.

The timekeeping button can be sized and shaped such that game players feel comfortable with the button. In the context of poker games, poker players typically like buttons that are disk or puck shaped. Accordingly, as shown in FIG. 1, the timekeeping button can include a generally cylindrical housing 30, although this is not required in all embodiments. As used herein, "generally cylindrical" should be interpreted to include shapes that have beveled edges and/or faces that are not perfectly planar. Many poker players have grown accustomed to buttons that are larger than the poker chips that serve as the currency of a poker game. Furthermore, many poker players and casino dealers like buttons to be noticeably different than the poker chips so that it is easy to quickly recognize the button on a table that is covered with poker chips. Therefore, a dealer button according to the present disclosure can be sized larger than a poker chip, although this is not required in all embodiments. As one nonlimiting example, a generally cylindrical button can have an approximately 5 cm to 6 cm diameter and an approximately 0.5 cm to 1.5 cm height.

Many poker players already own special poker equipment, such as special cases for carrying poker chips and boxes of cards. Therefore, to facilitate integration into a player's collection of poker items, the timekeeping button can be sized to be packaged in a standard card box, which in turn can be stored in any equipment that is designed for holding card boxes (e.g., poker chip cases). Furthermore, if a player has a special card box, the timekeeping button can be stored therein. In some embodiments, the packaging may include an adapter for snugly securing the timekeeping button within a standard card box and/or a player's special card box.

FIG. 1 shows button 10 with a complementarily configured adapter 40, which is designed to secure the button in a standard card box 42. Adapter 40 can be made out of virtually any material, including a cushioning foam that can help protect the timekeeping button. In the illustrated embodiment, card box 42 is designed to be opened at the top, in the same manner that an actual card box opens. This is not required, as some packaging can be sized and shaped as a standard card box, but open in a different manner, such as a hinged book. An adapter can be physically separate from the card box, or the adapter can be integrated with the card box.

A card box can be sized and shaped to match any standard card box. As a nonlimiting example, the card box can be approximately 9 cm long, 6.4 cm wide, and 1.2 cm deep. It should be understood that some standard card boxes may vary slightly from these dimensions because of differences between different card manufacturers. For example, some card boxes may be between 8.0 cm and 10.0 cm long, 6.0 cm and 8.0 cm wide, and 1.25 cm and 2.75 cm deep. Other standard card boxes, such as those made to hold jumbo sized cards, may be outside of these ranges. When a standard card box is used to package a cylindrical timekeeping button, the height of the button can be sized smaller than the depth of the card box packaging and the diameter of the button can be sized smaller than the width of the card box packaging.

Figure 2:
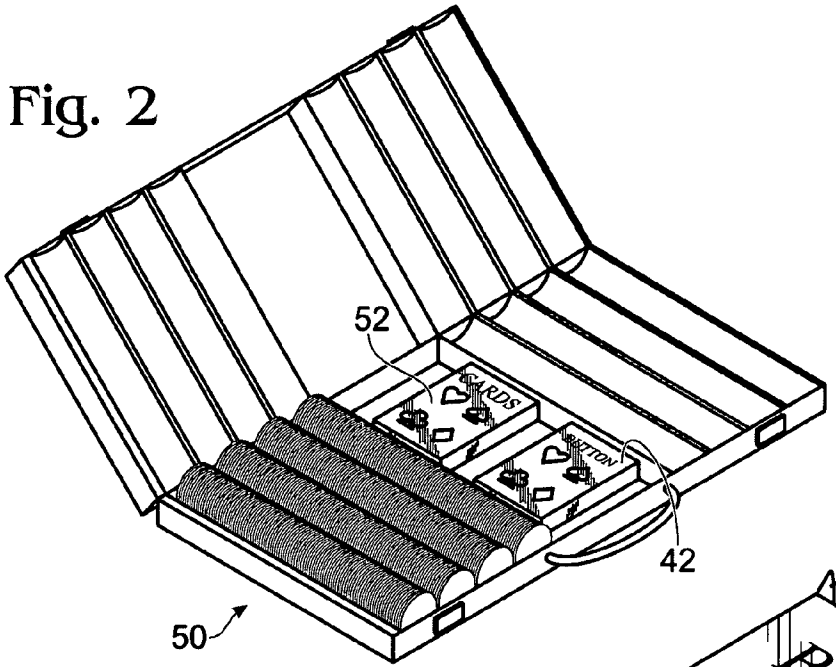
FIG. 2 shows the timekeeping button and optional packaging of FIG. 1 in a case designed to hold standard playing card boxes.

FIG. 2 shows a poker chip case 50 holding card box 42, which in turn is holding timekeeping button 10. Poker chip case 50 is also holding a deck of cards packaged in a standard card box 52. Poker chip case 50 is designed to hold two decks of cards. As such, the poker chip case can hold card deck 52 and timekeeping button 10 (as packaged in card box 42) without modification. If the timekeeping button was not packaged in card box 42, it could not easily integrate into poker chip case 50, nor the plethora of other poker paraphernalia that is already designed to accommodate a standard card box.

A timekeeping button, as described herein, can be used during a poker game to help keep track of the dealer's position and to monitor a betting schedule. The increment at which the betting amounts are to be changed can be set into the button and the primary timer can be started. The game can then be played as normal, with the button being passed around the gaming table as the dealer position changes. When time has elapsed, as indicated by the timekeeping button, the betting amounts can be changed and the timer can be restarted. Play can resume with minimal interruption.

The above described timekeeping button is a nonlimiting example of the timekeeping buttons contemplated in the following claims. Timekeeping buttons can include additional displays for presenting information such as the blind betting amounts. A timekeeping button can be configured to operatively communicate with one or more other devices, and such devices can be used to set a timing and/or betting schedule into the timekeeping button. In some embodiments, two or more timekeeping buttons can be configured to communicate with each other and/or a game server, so that information can be shared and/or synchronized across different buttons.

The invention claimed is:

1. A method of keeping track of a dealer position and a betting schedule in a multiplayer game, the method comprising:

setting a timer of a timekeeping button with a time interval at which a betting increment is to be changed;

starting the timer of the timekeeping button;

tracking time remaining in the time interval with the timekeeping button; and moving the timekeeping button to the dealer position as the dealer position changes throughout the multiplayer game.

2. A timekeeping button for a multiplayer game, comprising:

a first input configured to set a primary time interval, wherein the first input incrementally cycles through a set of preselected time intervals;

a second input configured to start and stop a counting of the primary time interval;

a display configured to present at least a remaining time of the primary time interval; and an alarm configured to indicate an end of the primary time interval.

3. The timekeeping button of claim 2, wherein the alarm includes a sound maker for audibly indicating an end of the primary time interval.

4. The timekeeping button of claim 2, wherein the alarm includes a light for visually indicating an end of the primary time interval.

5. The timekeeping button of claim 2, wherein the alarm provides a warning before an end of the primary time interval.

6. The timekeeping button of claim 2, wherein when the primary time interval is counting, the first input starts counting of a secondary time interval that does not disrupt counting of the primary time interval, and wherein the alarm indicates the end of the secondary time interval.

7. The timekeeping button of claim 2, further comprising a housing that is sized and shaped to fit in a standard card box.

8. The timekeeping button of claim 7, wherein the housing is generally cylindrically shaped.

9. The timekeeping button of claim 8, wherein the generally cylindrically shaped housing has an approximately 5 cm to 6 cm diameter and an approximately 0.5 cm to 1.5 cm height.

10. The timekeeping button of claim 2, wherein the alarm indicates whenever a function of the timekeeping button is changed.

11. The timekeeping button of claim 2, wherein the set of preselected time intervals includes time intervals greater than one hour.

12. A multiplayer gaming button sized and shaped for being moved around a game table to track a position of a dealer, the button comprising:

a timer tracking a remaining time in a game interval;

a bet indicator tracking a current betting amount;

a first display for presenting at least one of the remaining time and the current betting amount.

13. The multiplayer gaming button of claim 12, wherein the first display presents the remaining time and the current betting amount.

14. The multiplayer gaming button of claim 12, further comprising a second display, wherein the first display presents the remaining time and the second display presents the current betting amount.

15. The multiplayer gaming button of claim 12, further comprising an input for setting the current betting amount.

16. The multiplayer gaming button of claim 12, wherein the current betting amount is automatically selected from a predetermined betting schedule.

* * * * *